US005524322A

United States Patent [19]

Muehlen

[11] Patent Number: 5,524,322

[45] Date of Patent: Jun. 11, 1996

[54] RETAINING DEVICE FOR CASTERS AND SLIDES

[75] Inventor: Von Der Guenter Muehlen, Ennepetal, Germany

[73] Assignee: Plako GmbH Thermoplastik Und Formenbau, Ennepetal, Germany

[21] Appl. No.: 244,533

[22] PCT Filed: Jan. 23, 1993

[86] PCT No.: PCT/DE93/00054

§ 371 Date: May 27, 1994

§ 102(e) Date: May 27, 1994

[87] PCT Pub. No.: WO94/07704

PCT Pub. Date: Apr. 14, 1994

[30] Foreign Application Priority Data

Oct. 1, 1992 [DE] Germany ..... 92 13 417.3 U

[51] Int. Cl.[6] ..... B60B 33/00

[52] U.S. Cl. ..... 16/29; 16/30; 280/79.11; 280/32.6

[58] Field of Search ..... 16/18 R, 29, 30, 16/31 A, 42 R, 31 R, 43, 19, 18 CG; 280/79.11, 47.34, 3, 47.35, 32.6; 248/129

[56] References Cited

U.S. PATENT DOCUMENTS

| | | | |
|---|---|---|---|
| 2,174,661 | 10/1939 | Hope et al. | 16/18 R |
| 3,633,774 | 1/1972 | Lee | 280/79.11 |
| 4,060,252 | 1/1977 | Mowery | 16/18 R |
| 4,415,173 | 11/1983 | Tenebruso | 16/30 |
| 4,749,159 | 6/1988 | Hoff | 16/29 |
| 4,824,129 | 4/1989 | Rehrig | 280/79.11 |

FOREIGN PATENT DOCUMENTS

| | | | |
|---|---|---|---|
| 0251439 | 1/1988 | European Pat. Off. . | |
| 3815990 | 2/1989 | Germany . | |
| 2173093 | 10/1986 | United Kingdom . | |
| 2178725 | 2/1987 | United Kingdom | 280/79.11 |

*Primary Examiner*—Maurina T. Rachuba
*Assistant Examiner*—Chuck Y. Mah
*Attorney, Agent, or Firm*—Spencer & Frank

[57] ABSTRACT

A retaining system for retaining casters and slides. The retaining system is adapted to be fastened to a cabinet-like receptacle having side walls and a bottom, and includes at least one retaining device. The retaining device is comprised of: a bracket adapted to be fastened to the side walls of the cabinet-like receptacle at the bottom thereof without the interposition of a bottom plate; and a plurality of plates, each of the plates having a receiving pin for receiving one of a caster and a slide and being embedded in the bracket.

13 Claims, 4 Drawing Sheets

RETAINING DEVICE FOR CASTERS AND SLIDES

FIELD OF THE INVENTION

The invention relates to a retaining system for casters and slides the system including at least one retaining device which can be attached to the bottom of cabinet-like receptacles.

Cabinet-like—or chest-like—receptacles provided with casters or slides are those which, among other things, have a solid bottom panel, for example rolling containers, office containers, cabinets or devices. In many cases the bottom panel is exclusively used for stabilization and does not have a function as a pigeon hole or dust protector, particularly in those cases where there are drawers directly above the bottom panel. If required, casters or slides are fastened on this bottom panel.

BACKGROUND OF THE INVENTION

It is known to fasten casters or slides in special retaining devices, which then, in turn, are fixed by bolting, inserting, welding or gluing to the bottom panel of a cabinet-like receptacle, as a rule respectively one at each of the four corners of the bottom panel. This results in an elaborate construction and a time-consuming work process.

It is thus an object of the invention to provide a retaining device for casters and slide which obviates the disadvantages associated with the prior art.

SUMMARY OF THE INVENTION

According to the invention, a retaining device for casters and slides fulfills a stabilizing function for a cabinet-like receptacle by being configured to serve as the bottom panel of the cabinet-like receptacle.

Thus, in the present the invention, the retaining device is attached directly to the cabinet-like receptacle, which is open at its bottom, instead of being attached to a bottom panel of the receptacle first, as has been customary up to now. Because the retaining device simultaneously takes over the function of a bottom panel, a reduction of the structural components and simplification of assembly of the system are achieved.

BRIEF DESCRIPTION OF THE DRAWINGS

Exemplary embodiments of the invention are illustrated in the drawings and will be described in detail below. Shown respectively on a reduced scale are in.

DETAILED DESCRIPTION OF THE INVENTION

Figure 1:
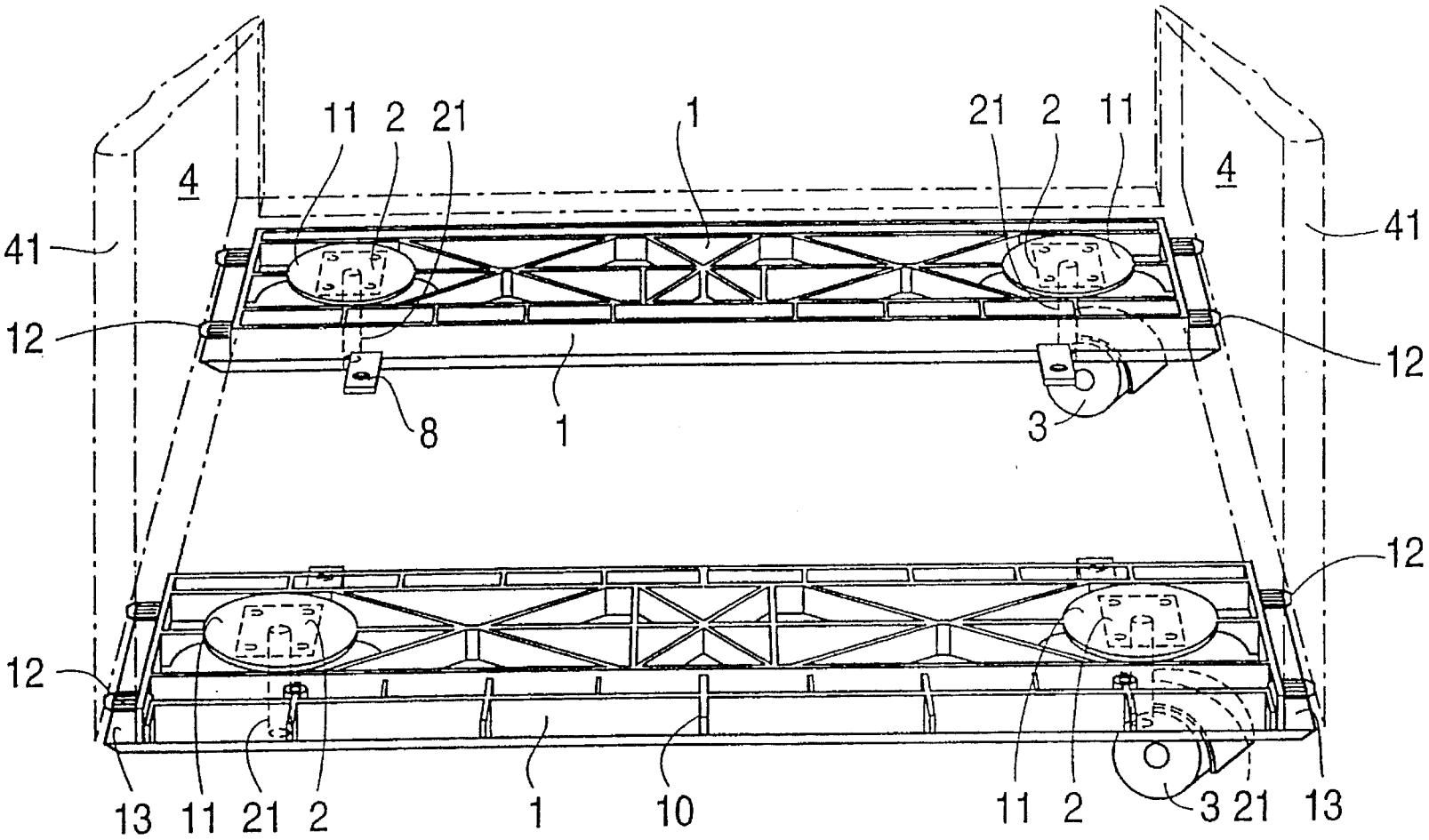
FIG. 1, a perspective view of front and rear retaining devices mounted on side walls of a cabinet open at its bottom.

Each one of the retaining devices selected as an exemplary embodiment has a plastic bracket 1. The plastic bracket 1 is embodied in the conventional manner as an injection-molded part with reinforcement ribs, bars or the like. The plastic bracket has a plate 11 in the area of its front/corners. A metal plate 2 has be embedded into the plastic bracket 1 in the area of the plate 11, or it may be injected into the plastic bracket during injection molding. The metal plate 2 is provided with a pin 21. Each pin 21 receives a caster 3 or a slide, not shown. The pins 21 for the casters 3 are suitably attached in such a way that the latter partially project into the plastic bracket 1. This makes possible a lesser bottom clearance 22 than with conventional retaining devices. Dowels 12 and a bar 13 are formed on the front and/or side walls of the plastic bracket 1. The dowels 12, which are arranged in one plane are used, together with the bar 13, for fastening the plastic bracket 1 on respectively one side wall 41 of a cabinet-like receptacle 4, open at the bottom, the remainder of which is not illustrated.

Figure 5:
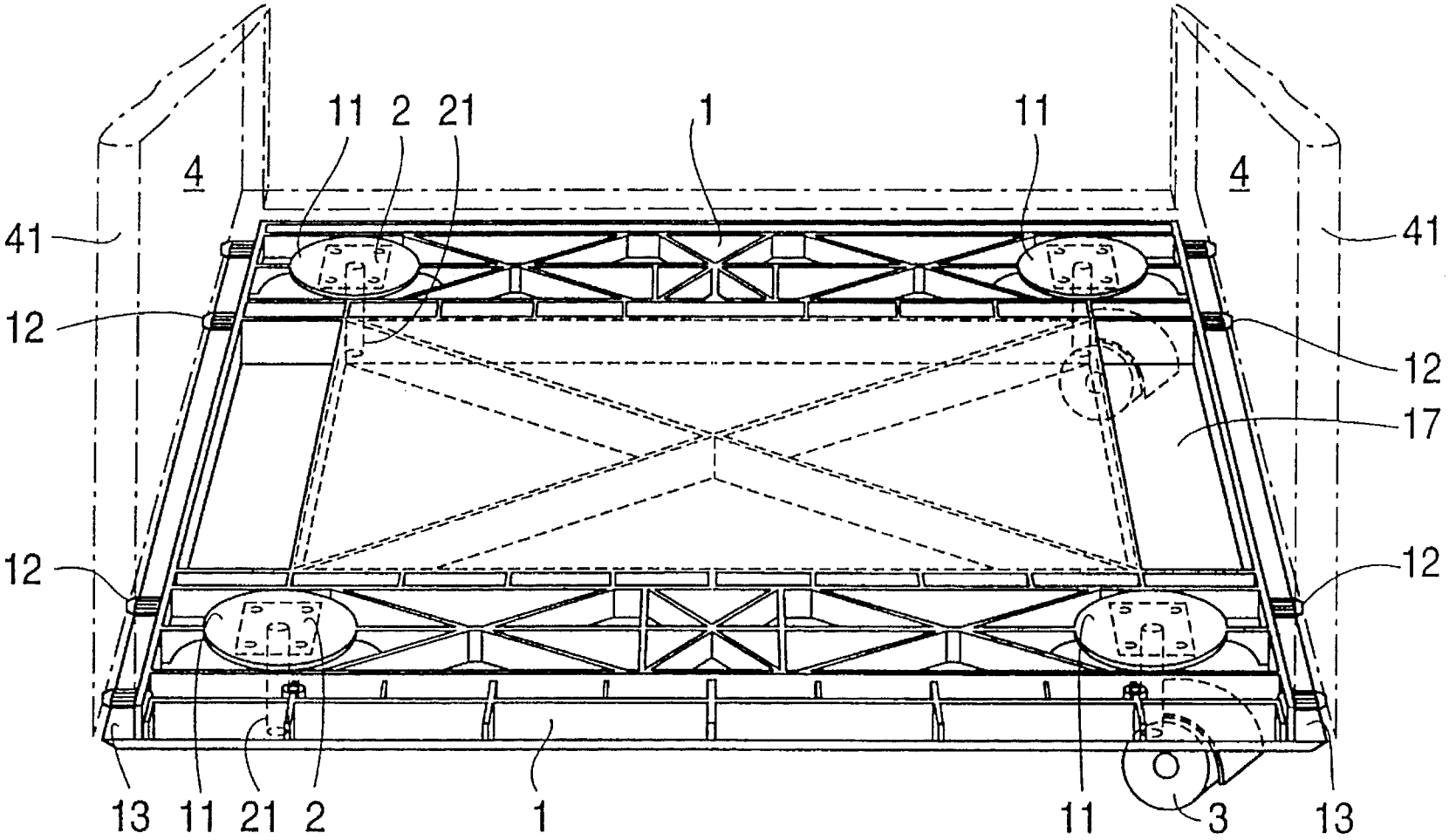
FIG. 5, a view corresponding to FIG. 1, a single retaining device occupying the entire bottom of the cabinet.

If cabinet-like receptacles with a bottom surface having an invariable length and width are equipped with the retaining system, an embodiment in accordance with FIG. 5 is recommended according to that embodiment, two plastic brackets 1, which form the actual retaining system, are connected by means of a reinforced intermediate plate 17. As in the exemplary embodiment, the retaining system can have include the metal plates 2 with the pin 21 for receiving the casters 3 at all four corners of the cabinet-like receptacle or on two corners which are part of the same side wall and at the center of the opposite side wall.

If cabinet-like receptacles with a bottom surface having an invariable width but a variable length are to be provided with a retaining system, the embodiment in accordance with FIG. 1 is recommended, according to that embodiment two plastic brackets 1 which are identical are used, one of which is used as the front and the other as the rear retaining device of the retaining system. Each one of these plastic brackets is then fastened in the area of the front or the rear side wall at the bottom of the cabinet-like receptacle.

Figure 6A:
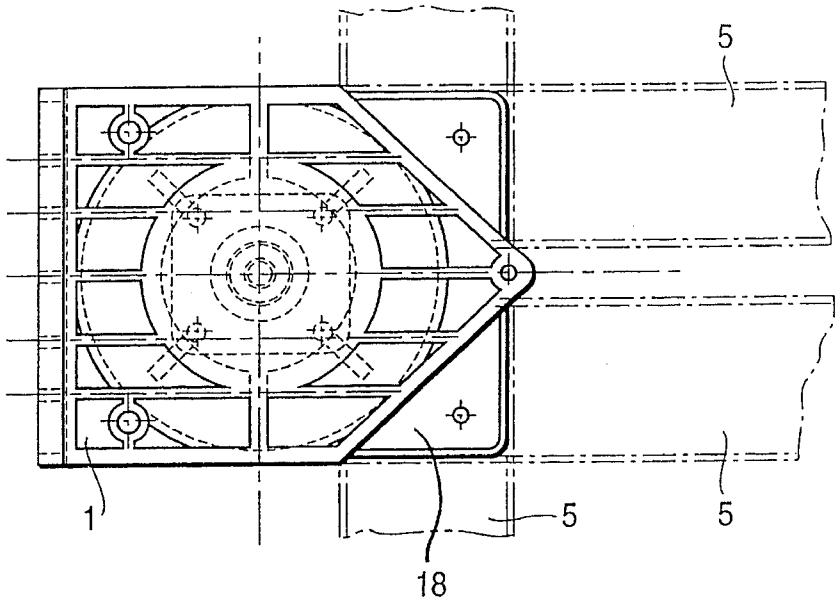
FIG. 6A, a top plan view of a single retaining device for application in a corner of a cabinet-like receptacle.
Figure 6B:
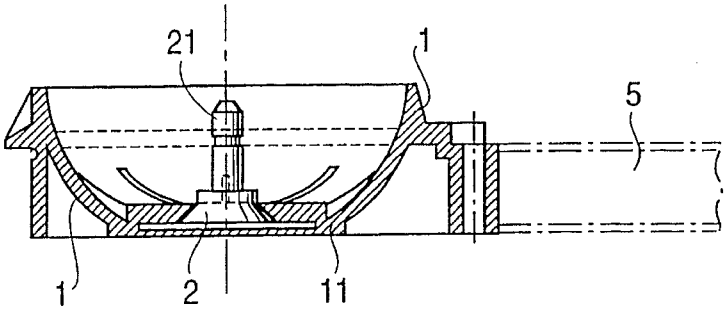
FIG. 6B, a side elevational view of the single retaining device of FIG. 6A.
Figure 6C:
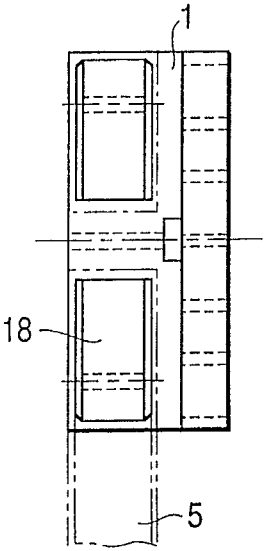
FIG. 6C, a longitudinal cross-sectional view of the single retaining device of FIG. 6A.

If cabinet-like receptacles having a variable length as well as a variable width are equipped with the retaining system, the use of the plastic bracket in accordance with FIG. 6 is recommended according to this embodiment one of the plastic brackets 1 is fastened on the bottom surface at each corner of the cabinet-like receptacle. For reasons of stabilization it is possible to connect all adjoining plastic brackets, or respectively two plastic brackets 1 disposed on the same side, with the aid of a profiled section 5, which can be changed in length. The profiled section 5 suitably is a metal profiled section which is pushed on a projection 18 formed on the plastic bracket 1.

Figure 4A:
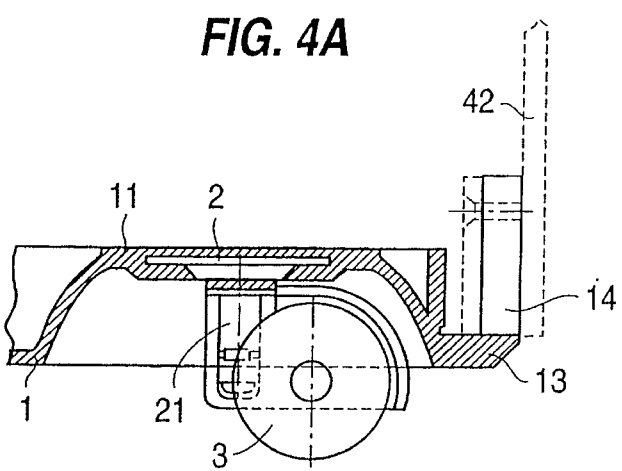
FIG. 4A, a cross sectional of a retaining device having a caster fastened thereto with reinforcing pins as the fastening for thin side walls.
Figure 4B:
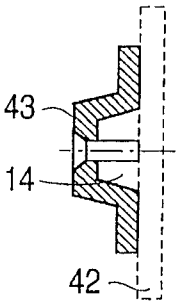
FIG. 4B, a cross sectional view of the reinforcing pin of FIG. 4A fastened to a thin side wall.
Figure 2:
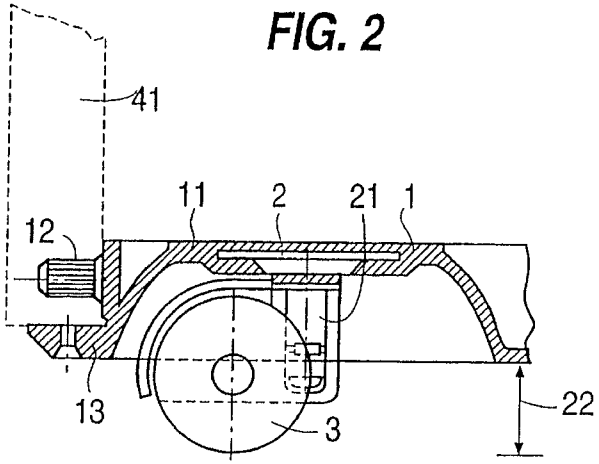
FIG. 2, a cross sectional view of a retaining device having a caster fastened thereto with a dowel and bolt connection as the fastening means.

The dowels 12 provided on the plastic bracket 1 are embedded in wood or particle board panels which form the side walls 41—FIGS. 1, 2, 5 and 6—. The plastic bracket 1 is then additionally bolted to the side wall 41 with the aid of a bolt, not shown—FIG. 2—. If the cabinet-like receptacle 4 has thin side walls 42, a reinforcing pin 14, which extends vertically to the bar 13, is used for fastening. A U-shaped fastening part 43, connected with the side wall 42 and having free ends projecting in the manner of a flange, is placed over the wedge-like reinforcing pin 14 and bolted —FIGS. 4A and 4B—.

If the cabinet-like receptacle is to receive an additional dust cover 44, a bolting tongue 15, which is provided with a bore for a bolt to pass through, is formed on the inside of the plastic bracket 1. The dust cover 44 is placed on the bolting tongue 15 and is bolted.

Figure 3A:
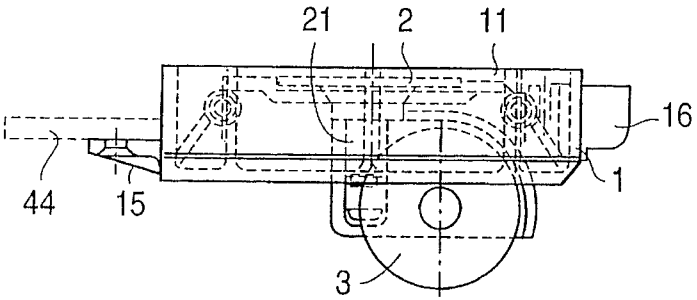
FIG. 3A, a front elevational view of the retaining device with an additional dust cover and with a device for receiving a decorative panel.
Figure 3B:
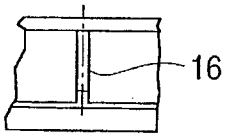
FIG. 3B, a front elevational view of the device for receiving a decorative panel shown in FIG. 3A.

If additional decorative panels, not shown, of the cabinet-like receptacle 4 are to be fastened, fasteners 16 for such decorative panels are formed on the plastic bracket 1—FIGS. 3A and 3B—.

The invention can be utilized with all cabinet-like receptacles which are initially open on the underside and are then provided with a bottom, for example rolling containers, office containers, cabinets or devices.

I claim:

1. A retaining system for retaining casters and slides, the retaining system being adapted to be fastened to a cabinet-like receptacle having side walls and a bottom, the retaining system further comprising at least one retaining device including:

a bracket adapted to be fastened to the side walls of the cabinet-like receptacle at the bottom thereof without the interposition of a bottom plate; and a plurality of plates, each of the plates having a receiving pin for receiving one of a caster and a slide and being embedded in the bracket.

2. The retaining system according to claim 1, wherein the plurality of plates includes at least three plates.

3. The retaining system according to claim 1, wherein:

the at least one retaining device includes two retaining devices; and the bracket of each of the two retaining devices is configured to extend from a first side wall to a facing second side wall of the cabinet like receptacle, the bracket thereby being adapted to be fastened to the first side wall at one end thereof and to the second side wall at another end thereof such that a first one of the two retaining devices forms a front retaining device and a second one of the two retaining devices forms a rear retaining device of the cabinet-like receptacle.

4. The retaining system according to claim 1, wherein:

the at least one retaining device includes four retaining devices; and the brackets of the four retaining devices are configured to be fastened at each of four corners of the cabinet-like receptacle, respectively.

5. The retaining system according to claim 4, further including at least one fitted hollow profile section for connecting two adjoining ones of the brackets to one another when the brackets are fastened at each of the four corners of the cabinet-like receptacle.

6. The retaining system according to claim 1, wherein the bracket includes a plurality of dowels formed thereon and adapted to be inserted into the side walls for fastening the bracket thereto.

7. The retaining system according to claim 6, wherein the bracket includes a fastening side adapted to be fastened to one of the side walls of the cabinet-like receptacle, the bracket further comprising a bar at the fastening side thereof for supporting said one of the side walls, the bar further being configured to be bolted to said one of the side walls.

8. The retaining system according to claim 1, wherein the bracket includes a fastening side adapted to be fastened to one of the side walls of the cabinet-like receptacle, the bracket further comprising a reinforcing pin at the fastening side thereof configured to be fastened to said one of the side walls.

9. The retaining system according to claim 1, wherein the receiving pin of each of the plates partially project into the bracket.

10. The retaining system according to claim 1, the bracket including a bolting tongue for fastening a dust cover thereon.

11. The retaining system according to claim 1, wherein the bracket includes fasteners for fastening decorative panels thereto.

12. The retaining system according to claim 1, wherein:

the bracket is made of plastic and is formed by injection molding; and the plates are embedded in the bracket by being injected therein.

13. The retaining system according to claim 1, wherein the plates are made of metal.

* * * * *

UNITED STATES PATENT AND TRADEMARK OFFICE

CERTIFICATE OF CORRECTION

PATENT NO. : 5,524,322
DATED : June 11, 1996
INVENTOR(S) : Guenther VON DER MUEHLEN It is certified that error appears in the above-indentified patent and that said Letters Patent is hereby corrected as shown below:

On the title page, item [75], the inventor's name should read --Guenter VON DER MUEHLEN--.

Signed and Sealed this

Tenth Day of September, 1996

*Attest:*

*Attesting Officer*

BRUCE LEHMAN

*Commissioner of Patents and Trademarks*